US005881891A

United States Patent [19]

Murphy, Jr.

[11] Patent Number: 5,881,891

[45] Date of Patent: Mar. 16, 1999

[54] CLEANING ORGANIZER FOR USE WITH CONVENTIONAL INSTITUTIONAL WASTE CONTAINERS

[76] Inventor: Erle N. Murphy, Jr., 5557 Oak Glen Rd., Edina, Minn. 55439

[21] Appl. No.: 848,864

[22] Filed: May 1, 1997

[51] Int. Cl.[6] ..... A47F 7/00

[52] U.S. Cl. ..... 211/70.6; 211/65; 211/86.01; 211/71.01

[58] Field of Search ..... 211/65, 66, 70.6, 211/86.01, 88.01, 71.01; 248/99

[56] References Cited

U.S. PATENT DOCUMENTS

| | | | |
|---|---|---|---|
| 2,035,639 | 3/1936 | Davis | 211/70.6 X |
| 3,210,091 | 10/1965 | Ng | 211/70.6 X |
| 3,298,532 | 1/1967 | Wilcke | 211/70.6 |
| 3,342,343 | 9/1967 | Youlden | 211/88.01 |
| 3,780,874 | 12/1973 | Stacy | 211/65 |
| 4,475,660 | 10/1984 | Cain | 211/71.01 X |
| 4,947,998 | 8/1990 | Smeller | 211/70.6 |
| 5,704,496 | 1/1998 | Latta | 211/70.6 |

*Primary Examiner*—Robert W. Gibson, Jr.

[57] ABSTRACT

A cleaning organizer for use with a conventional institutional waste container includes a symmetrical body for mounting on the upper end of the institutional waste container and extending exteriorly downwardly therefrom. A plurality of cleaning implements and articles are attached to the exterior surface of the body for ready access by a user. The cleaning implements and articles include a paper towel roll dispenser, a utility bucket, a compartmented chemical container, a utility pouch, dispensers for dispensing large and small plastic liners, and hooks for hanging towels and cloths. The cleaning organizer is arranged and constructed to leave the open upper end of the institutional waste container unobstructed while organizing the various cleaning implements and articles needed for performing the various cleaning tasks.

14 Claims, 2 Drawing Sheets

CLEANING ORGANIZER FOR USE WITH CONVENTIONAL INSTITUTIONAL WASTE CONTAINERS

FIELD OF THE INVENTION

This invention relates to cleaning systems and more particularly to a cleaning organizer for use with conventional institutional waste containers.

BACKGROUND OF THE INVENTION

The cleaning of large office buildings, hotels, schools, and similar institutions is a labor intensive industry. Typically, each worker (cleaner) has an assigned area to clean including offices, bathrooms etc. Trash removal is an essential part of the cleaning effort and most workers are provided with a convention institutional waste container which is usually mounted on a detachable dolly. This institutional waste container is pushed from one cleaning site to the next site (office, bathroom etc.).

Trash and waste material from the cleaning sites is emptied into the institutional waste container. Each worker also performs a number of cleaning tasks such as dusting, sweeping, vacuuming, etc. In bathrooms, the worker cleans mirrors, counters, urinals and toilets. Plastic liners for waste containers are replaced when the containers are emptied at all the cleaning sites.

Typically, each worker is required to carry the various articles and implements used in the cleaning tasks. In some instances, these implements and cleaning articles are not readily available to the worker which results in time lost as the worker retrieves the needed article or implement.

Some manufacturers presently manufacture specially designed carts which contain all of the articles and implements used in cleaning operations. However, many institutions are reluctant to purchase these specially designed cleaning carts since these institutions already own large numbers of the conventional institutional waste containers. An investment in the purchase of these cleaning carts, in many cases, would be prohibitive.

SUMMARY OF THE INVENTION

An object of this invention is to provide a novel cleaning organizer for use with a conventional institutional waste container and which supports a plurality of cleaning implements and articles for performing the conventional cleaning task.

A more specific object of this invention is the provision of a novel cleaning organizer for mounting on the upper end of a conventional institutional waste container and having an exterior surface for supporting a plurality of cleaning tools and articles needed for performing the various cleaning tasks.

These features and other objects and advantages of the invention will be readily apparent from the following description of certain preferred embodiments thereof, taken in conjunction with the accompanying drawings although variations and modification may be effected without departing from the spirit and scope of the novel concepts of the disclosure in which:

DESCRIPTION OF THE PREFERRED EMBODIMENT

Figure 3:
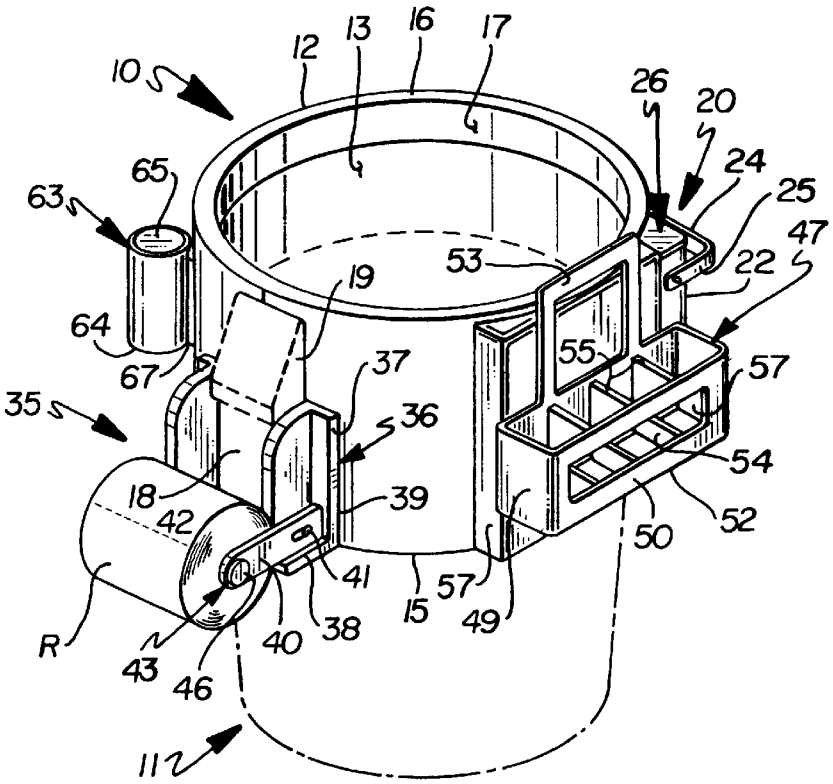
FIG. 3 is a perspective view of the cleaning organizer mounted on a conventional institutional waste container in the manner of FIG. 2 but illustrated from a different perspective.
Figure 2:
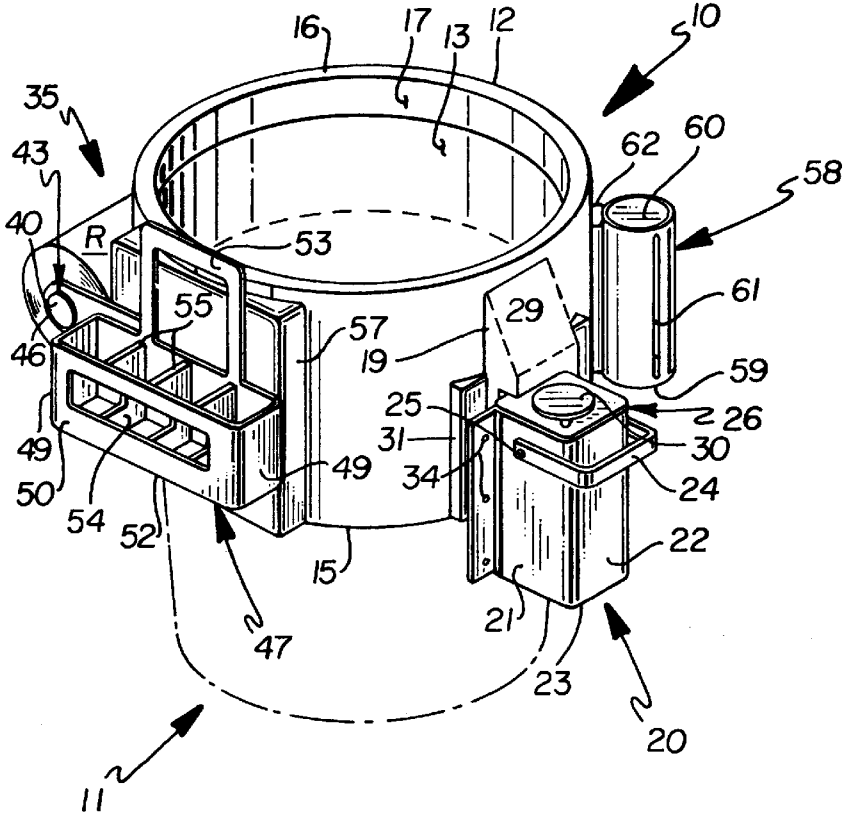
FIG. 2 is a perspective view of the cleaning organizer illustrated in mounted relation on a conventional institutional waste container.

Referring now to the drawings, it will be seen that one embodiment of my novel cleaning organizer, designated generally by the reference numeral 10, is thereshown. The cleaning organizer 10 is adapted to be mounted on the upper end of a conventional institutional waste container 11, as best seen in FIGS. 2 and 3. In the embodiment shown, the waste container 11 is of generally cylindrical construction and is routinely used by cleaning organizations engaged to clean large institutions such office buildings, schools, hospitals, and the like. The cleaning organizer 10 includes a generally cylindrical body 12 which is formed of a suitable rigid plastic material. It is pointed out, however, that the body 12 may have other geometrical shapes to fit other geometrically shaped institutional waste containers. For example, some institutional waste containers are generally rectangular configuration. In any event, my cleaning organizer 10 will have a body 12 which is shaped and sized to fit any conventional institutional waste container.

The cylindrical body 12 has an interior surface 12, an exterior surface 14, a lower edge 15 and an inwardly extending annular flange 16 defining the upper surface thereof. The inwardly extending annular flange terminates in a downturned annular lip 17. When the cleaning organizer is applied to a conventional institutional waste container 11, the upper edge of the waste container 11 engages the lower surface of the inwardly extending annular flange 16 with the downturned lips 17 positioned inwardly of the upper edge portion of the waste container. With this arrangement, the open upper end of the institutional waste container remains unobstructed to permit a user to empty trash and waste material into the container.

The body 12 is provided with a pair of substantially identical diametrically opposed openings 18 therein which extend upwardly through the lower edge 15 of the body and terminate adjacent the annular flange 16. In the embodiment shown, the openings 18 are of generally rectangular configuration and accommodate the handles 19 of the institutional waste container 11 therethrough.

The cleaning organizer also has a plurality of cleaning implements and articles attached to the exterior surface thereof for ready access by a user. A utility bucket 20 or implement is detachably connected to the exterior surface of the body 12 adjacent one of the openings 11, as best seen in FIG. 2. The utility bucket is of generally rectangular configuration and includes opposed side walls 21, opposed end walls 22 and a bottom wall 23. The utility bucket has an open top which is closed by a cover 26. The cover 26 is of generally rectangular configuration and has a reduced lower portion 27 which fits within the open top of the bucket.

Figure 1:
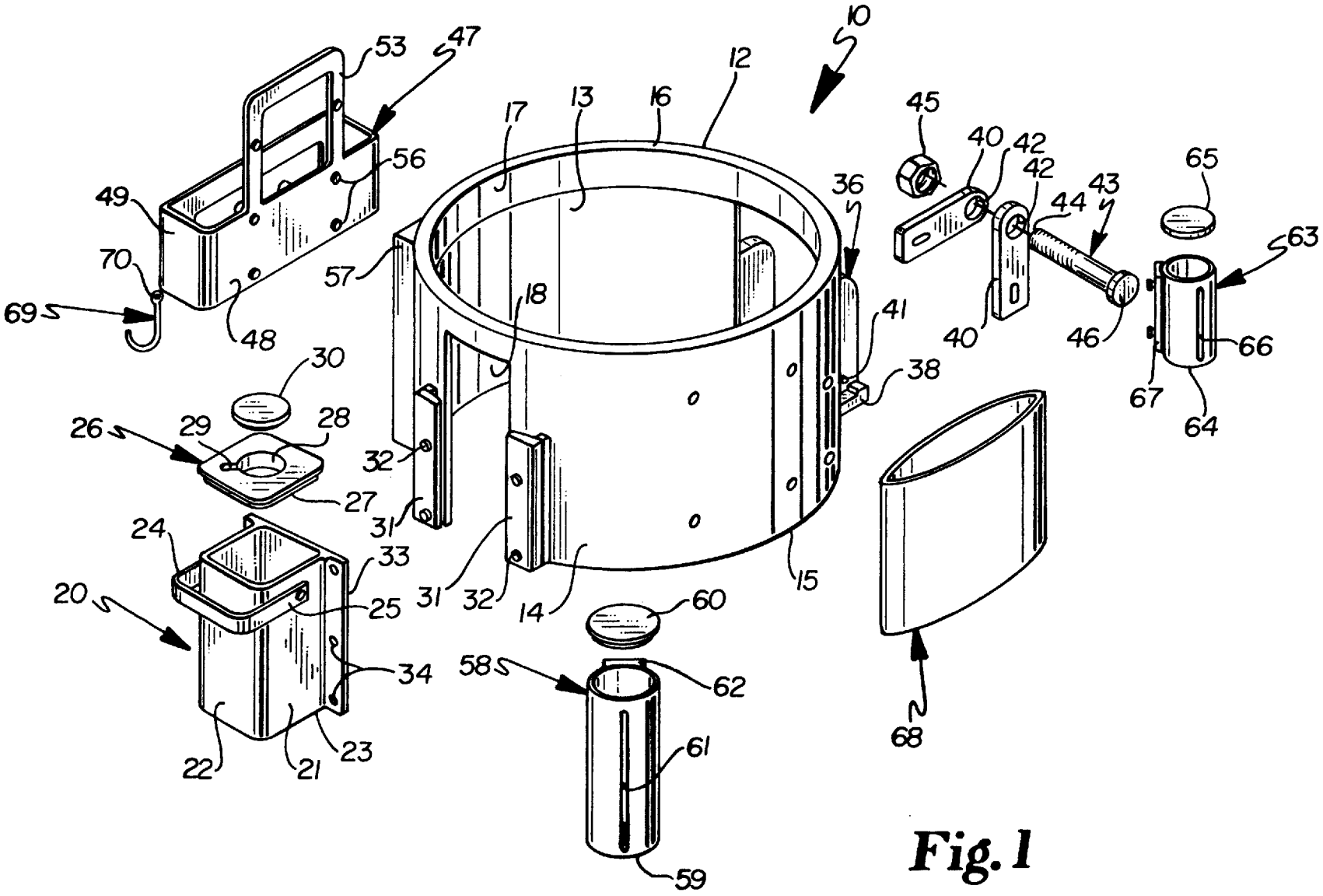
FIG. 1 is an exploded perspective view of the cleaning organizer illustrating the various implements and articles that are attached thereto.

The cover also has a central circular opening 28 therein and a notch 29 which communicates with the opening, as best seen in FIG. 1. A circular closure member 30 closes the opening 28 during use. The bucket is also provided with a U-shaped handle 24 which is pivotally connected to the side walls 21 for swinging movement of the handle between an upright carrying position and a lowered inoperative position.

Although the utility bucket is of rectangular configuration, the bucket may have other configurations.

The utility bucket may be used in cleaning urinals and toilets, and the slot 29 in the cover 26 is adapted to receive the handle of a johnny mop therethrough. The bucket usually contains a solution of water and chemicals necessary for the particular cleaning task undertaken.

Means are also provided for mounting the utility bucket 20 on the body 12. In this regard, it will be noted that the body 12 has a pair of laterally spaced apart mounting strips 31 mounted thereon adjacent the opposed edges defining one of the openings 18. Each mounting strip 31 has a pair of vertically spaced apart studs 32 thereon, each stud including a shank and head which projects outwardly from the strip.

It will be noted that one of the end walls 22 of the utility bucket projects laterally outwardly from the side walls 21 to define a pair of flanges 33. Each flange 33 each has three vertically spaced apart key hole openings 34 therein. A pair of the key hole openings accommodates the studs on a mounting strip 31. With this arrangement, the utility bucket may be readily attached to and detached from the body 12.

The cleaning organizer 10 also includes a paper towel roll dispenser or implement 35 which includes a pair of substantially similar brackets 36 each having a vertically disposed laterally extending flange 37 integrally formed therewith and projecting outwardly therefrom. A horizontal stop 38 integrally formed with the lower end of a bracket 36 and with the associated flange 37.

It will be seen that each bracket 36 is mounted adjacent an opening 18 in the body 12 and is disposed in opposed relation with respect to the utility bucket 20. In this regard, each bracket is attached to one of a pair of mounting strips 39 which are secured to the body 12. The mounting strips are attached to the body 12 by suitable securing means such as bolts or the like.

The paper towel roll dispenser also includes a pair of substantially identical elongate arms 40 each being pivotally connected at its inner end by a pivot 41 to one of the brackets. The arms are vertically swingable between a horizontal operative position and a vertical inoperative position. The horizontal stop 38 limits downward movement of the arms to the horizontal position and a detent friction lock (not shown) of conventional construction engages the pivot 41 and releasably locks the arms in a vertical position. The arms are releasable from their locked vertical position by simply exerting the necessary force to overcome the frictional locking effect of the detent.

Each of the arms 40 also has an opening in its outer end for accommodating the axle or elongate roll support 43 therethrough. One end of the roll support 43 is provided with external threads for threaded engagement with a nut 45. The other end of the roll support 43 is provided with a head 46 for limiting longitudinal movement of the roll support relative to the associated arm when the nut is attached thereto. The roll support 43 supports a roll of paper towels R thereon for ready access by a user.

The cleaning organizer also includes a compartmented carrier or implement 47 for supporting various chemical containers which are used in the cleaning operation. The compartmented carrier 47 is of generally rectangular configuration and includes a rear wall 48, opposed end walls 49 and a front wall 50. Front wall 50 is provided with a generally rectangular opening 51 therein to provide visual access to the labels on the bottles. The compartmented carrier also includes a bottom wall 52 and is provided with an inverted U-shaped carrying handle 53 which is integral with the rear wall 48 and projects upwardly therefrom. The carrier 47 is provided with a plurality of spaced apart vertical divider walls 54 which are connected at their upper ends by transverse strips 55. Each compartment in the compartmented carrier accommodates a chemical container which may be readily removed and replaced with respect to the carrier.

Means are provided for detachably connecting the compartmented carrier 47 to the body 12 and this means includes a plurality of studs 56 on the rear wall 48 and handle 53. Each stud has a shank and a head for insertion into key hole openings (not shown) on mounting strips 57 which are secured to the body 12. Again, it will be noted that the compartmented carrier may be readily attached to and detached from the body 12 in the manner of the utility bucket 20 and the paper towel roll dispenser 35.

The cleaning organizer 10 also includes a large cylindrical plastic liner dispensing container or implement 58 for containing a roll of large plastic liners which are used in large waste receptacles. It will be noted that the large dispensing container 58 is provided with a bottom wall 59 and a top cover 60. The top cover is pivoted to the container 58 by a pivot 60*a* for pivoting movement about a vertical axis between opened and closed positions. The large cylindrical container has a vertical dispensing slot 61 therein through which the large plastic liners are dispensed.

The large dispensing container is secured to a mounting strip 62 which is in turn secured to the body 12 by suitable attaching means such as screws or the like.

The cleaning organizer also includes a small cylindrical plastic liner dispensing container or implement 63 for use in containing and dispensing a roll of small plastic liners used in the smaller sized waste receptacles typically found in offices. The small dispensing container 63 also includes a bottom wall 64 and top cover 65 which is pivoted to the container by a pivot 65*a*. The top cover is swingable horizontally about a vertical axis between opened and closed positions. The dispensing container 63 is provided with a vertically extending dispensing slot 66 therein through which the smaller plastic liners are dispensed.

The dispensing container 63 is also provided with a mounting strip 67 fixedly secured thereto. The mounting strip is secured to the body 12 by suitable securing means such as screws and the like.

The cleaning organizer further includes an open top flexible pouch or implement 68 which is secured to the exterior wall of the container by suitable bolts or the like. The flexible pouch 68 is preferably formed of a flexible, durable plastic material and is adapted to contain various cleaning articles such as dusting cloths, cleaning cloths, towels, sponges and the like.

Finally, the cleaning organizer is provided with a plurality of hook implement or hooks 69, although only one such hook is illustrated in the enclosed drawings. Each hook 69 is of curved configuration and is preferably formed of a suitable metal and is provided with an eye 70 at its upper end. Each hook 69 is secured to the body 12 by means of a bolt assembly passing through the eye and through an opening in the body. In the preferred embodiment, two such hooks will be provided and each serves as a hanger for towels and wiping cloths.

In use, my novel cleaning organizer will be mounted on a conventional institutional waste container by simply sliding the body 12 downwardly over the upper end of the institutional container until the upper edge of the container engages the lower surface of the inwardly extending annular flange 16. Similarly, the organizer may readily be removed from the institutional waste container. The institutional waste container or implement 11 will be preferably mounted on a conventional dolly which is provided for moving the waste containers from site to site.

The interior of the institutional container will remain completely unobstructed when the cleaning organizer 10 is mounted thereon to permit a user to empty garbage and waste therein.

The user or cleaner will push the institutional waste container with the cleaning organizer mounted thereon to a cleaning site where the cleaner will undertake to perform the cleaning task. All of the implements and articles needed for cleaning will be readily available for the user and will be at a convenient location on the institutional waste container for ready access by the user. By having all of these cleaning implements and articles used for cleaning located exteriorly of the conventional waste container, the articles and implements will be arranged and organized for permitting efficient performance of the cleaning tasks by a user.

Should the user encounter a doorway which is somewhat narrower than the width dimension of the institutional waste container with the cleaning organizer mounted thereon, the user may reduce the effective width of the cleaning organizer by selectively removing the larger articles such as the utility bucket 20 or the compartmented carrier 47. It will be appreciated that this detachment can be readily accomplished through the simple expediency of disengaging the studs from the key hole slots. Thereafter, the institutional waste container (with the cleaning organizer mounted thereon) may be pushed through the doorway and the detached implements reattached to the body 12.

In instances where several toilets or urinals are to be cleaned, the user, of course, will need the compartmented carrier 47 (with the required chemical containers) and the utility bucket 20. In order to facilitate carrying the utility bucket and chemical carrier from location to location, the user may detach the compartmented carrier and utility bucket from the body 12 and may attach the utility bucket to the chemical carrier to form a single cleaning subunit. The studs on the chemical carrier 47 may engage in the key hole slots 34 of the utility bucket 20 to releasably attach the bucket to the carrier. This arrangement is particularly advantageous for use in cleaning bathrooms.

From the foregoing description, it will be noted that my cleaning organizer is readily mountable on an institutional waste container, one of the primary cleaning components used by most cleaning companies. It will be seen that when the cleaning organizer is mounted on an institutional waste container, all of the cleaning articles and implements are compactly arranged and conveniently positioned for ready access by a user.

Thus it will be seen that my cleaning organizer substantially increases the efficiency of a user in performing the cleaning task and thereby substantially reduces labor costs.

It will therefore be seen that my novel cleaning organizer, which is of simple and inexpensive construction, arranges and positions the articles and cleaning implements needed in cleaning in a more efficient manner than any heretofore known comparable device.

What is claimed is:

1. A cleaning organizer for use with a conventional upwardly opening institutional waste container having handles comprising;

a generally cylindrically shaped body for mounting on the upper exterior end portion of a conventional institutional waste container, said body having a generally cylindrical exterior surface, an annular upper edge and an annular lower edge, an annular flange integral with said upper edge and extending radially inwardly therefrom, a cylindrical lip integral with said flange and extending downwardly therefrom and positioned interiorly of a waste container when the organizer is mounted on a container, cleaning implement means for attachment to the exterior surface of the body selected elected from the group consisting of a paper towel roll dispenser implement, a dispenser implement for containing and dispensing a roll of plastic liners for large waste containers, a dispenser implement for containing and dispensing a roll of plastic liners for small waste containers, a utility bucket implement having a handle, a compartmented carrier implement for chemical containers, a utility pouch and a plurality of hook implements for supporting towels and cloths, and means for attaching the cleaning implement means to the exterior cylindrical surface of the body.

2. A cleaning organizer for use with a conventional upwardly opening institutional waste container having handles comprising;

a generally cylindrically shaped body for mounting on the upper exterior end portion of a conventional institutional waste container, said body having a generally cylindrical exterior surface, an annular upper edge and an annular lower edge, an annular flange integral with said upper edge and extending radially inwardly therefrom, a cylindrical lip integral with said flange and extending downwardly therefrom and being positioned interiorly of a waste container when the body is mounted on the container, a plurality of cleaning implements for attachment to the exterior surface of the body including a paper towel roll dispenser, a dispenser for containing and dispensing a roll of plastic liners for large containers, a dispenser for containing and dispensing a roll of plastic liners for small containers, a utility bucket having a handle, a compartmented carrier for chemical containers, a utility pouch, and a plurality of hooks for supporting towels and cloths, and means for attaching the cleaning implements to the exterior surface of the body.

3. The cleaning organizer as defined in claim 1 wherein certain of said implement means are removably attached the support body for ready detachment therefrom including the utility bucket implement.

4. The cleaning organizer as defined in claim 1 wherein the support body as openings therein through which the handles of a conventional institutional waste container project.

5. The cleaning organizer as defined in claim 1 wherein said implement means comprises a utility bucket implement and compartmented carrier implement are removably attached to the support body for ready detachment therefrom, cooperating means on said utility bucket implement and compartmented carrier implement for permitting ready attachment of the utility bucket implement and compartmented carrier implement together when said bucket and carrier are detached from the support body.

6. The cleaning organizer as defined in claim 1 wherein said implement means comprises a paper towel roll dispenser implement.

7. The cleaning organizer as defined in claim 1 wherein said implement means comprises a utility bucket implement having a body engaging surface, cooperating means on the exterior surface of said body and said body engaging surface for releasably attaching the utility bucket implement to the body.

8. The cleaning organizer as defined in claim 1 wherein said implement means comprises a compartmented carrier implement for chemical containers, cooperating means on said chemical container implement and body for releasably attaching the compartmented carrier implement to the body.

9. The cleaning organizer as defined in claim 2 wherein certain of said implements are removably attached to the support body for ready detachment therefrom including the utility bucket and the compartmented carrier.

10. The cleaning organizer as defined in claim 2 wherein the support body as openings therein through which the handles of a conventional institutional waste container project.

11. The cleaning organizer as defined in claim 2 wherein said utility bucket and compartmented carrier are removably attached to the support body for ready detachment therefrom, cooperating means on said utility bucket and compartmented carrier for permitting ready attachment of the utility bucket and compartmented carrier together when said bucket and carrier are detached from the support body.

12. The cleaning organizer as defined in claim 2 wherein said cleaning implements and articles include a paper towel roll dispenser.

13. The cleaning organizer as defined in claim 2 wherein said cleaning implements and articles include a utility bucket having a body engaging surface, cooperating means on the exterior surface of said body and said body engaging surface for releasably attaching the utility bucket to the body.

14. The cleaning organizer as defined in claim 2 wherein said cleaning implements and articles include a compartmented carrier for chemical containers, cooperating means on said chemical container and body for releasably attaching the compartmented carrier to the body.

* * * * *